US007703182B2

(12) United States Patent
Bonaglia

(10) Patent No.: US 7,703,182 B2
(45) Date of Patent: Apr. 27, 2010

(54) HERMETICALLY SEALED ZIP FASTENER WITH SLIDER WHICH GRIPS THE TEETH SUPPORTING STRIPS

(75) Inventor: Benedetto Bonaglia, Gentilino (CH)

(73) Assignee: Riri Group SA, Mendrisio (CH)

( * ) Notice: Subject to any disclaimer, the term of this patent is extended or adjusted under 35 U.S.C. 154(b) by 88 days.

(21) Appl. No.: 11/791,956

(22) PCT Filed: Nov. 30, 2005

(86) PCT No.: PCT/IB2005/003696

§ 371 (c)(1),
(2), (4) Date: May 31, 2007

(87) PCT Pub. No.: WO2006/067571

PCT Pub. Date: Jun. 29, 2006

(65) Prior Publication Data

US 2008/0229553 A1 Sep. 25, 2008

(30) Foreign Application Priority Data

Dec. 20, 2004 (CH) ..... 2107/04

(51) Int. Cl.
*A44B 19/32* (2006.01)

(52) U.S. Cl. ..... 24/389; 24/416

(58) Field of Classification Search ..... 24/384, 24/389, 416

See application file for complete search history.

(56) References Cited

U.S. PATENT DOCUMENTS

| | | | | |
|---|---|---|---|---|
| 3,030,683 | A * | 4/1962 | Doelter | 24/384 |
| 3,376,617 | A * | 4/1968 | Snyder | 24/416 |
| 3,990,130 | A | 11/1976 | Hattori et al. | |
| 4,604,775 | A | 8/1986 | Kusayama et al. | |

FOREIGN PATENT DOCUMENTS

| | | |
|---|---|---|
| EP | 1 201 144 A | 5/2002 |
| WO | 2004/014173 | 2/2004 |

* cited by examiner

*Primary Examiner*—James R Brittain
(74) *Attorney, Agent, or Firm*—Young & Thompson

(57) ABSTRACT

A hermetically sealed zip fastener includes two rows of facing teeth mounted on two strips of compressively elastic material, the teeth being joined and disengaged by a movable slider which can be displaced by gripping its outwardly projecting gripping member. On opposite sides of the strips, the slider has first and second concave capsules, substantially mirror-images of each other, arranged with the perimetral edges of their concavities opposite and facing each other, the first capsule having directed upwards a pin perpendicular thereto and able to slide perpendicularly through a cavity inside the slider and through a hole in the second capsule. The gripping member, when actuated, causes simultaneous displacement of the first towards the second capsule and of the second towards the first capsule perpendicular to the plane of the zip fastener, moving end parts of their perimetral edges together sufficient to grip between them, with desired pressure, the strips.

10 Claims, 6 Drawing Sheets

HERMETICALLY SEALED ZIP FASTENER WITH SLIDER WHICH GRIPS THE TEETH SUPPORTING STRIPS

The present invention relates to the sector of hermetically sealed zip fasteners, namely those type of zip fasteners which must form an impenetrable barrier preventing the passage of fluids.

Recently numerous solutions have been devised with the aim of preventing the passage of water, air and gases under pressure between the two rows of teeth which face each other and are mounted on strips of material with a relative compressive elasticity. As is known, the said teeth are joined together by a member, called a slider, which is movable and is displaced by gripping a gripping member such as a pull tag or the like.

When the zip fastener is closed, on its end part where the abovementioned slider is mounted, there is the risk of infiltration between the zone of the teeth and the slider part which is necessarily situated between them, and the abovementioned preventive measures are of no use and effective only in the zones where the teeth are joined together and their strips pressed against each other.

In order to overcome this drawback, the inventor of the subject of the present invention has devised a zip fastener of the type described hitherto in which, however, a first and a second concave capsule having a form which is substantially a mirror-image of each other and arranged with the perimetral edges of their concavities opposite and facing each other are provided on the slider and on opposite sides thereof.

One of the said capsules has a pin which is perpendicular thereto and able to slide through the slider body and through a hole formed in the other capsule, and the abovementioned gripping member is connected to means which, when they are actuated, cause a simultaneous displacement of both the capsules towards each other in a direction perpendicular to the plane of the zip fastener, with the result that the two strips of elastic material supporting the teeth are gripped between the said capsules with a desired pressure. In this way the already described zone where the teeth and slider are joined together, where there is a potential risk of infiltration, remains enclosed within the perimetral edges of the abovementioned capsules, which act as a barrier against the passage of a liquid.

The object of the present invention is therefore to provide a hermetically sealed zip fastener in accordance with that described in the accompanying independent claims.

Two preferred examples of embodiment of a zip fastener according to the invention will now be described and, during the course of the description, reference will also be made to the accompanying drawings in which.

Figure 1:
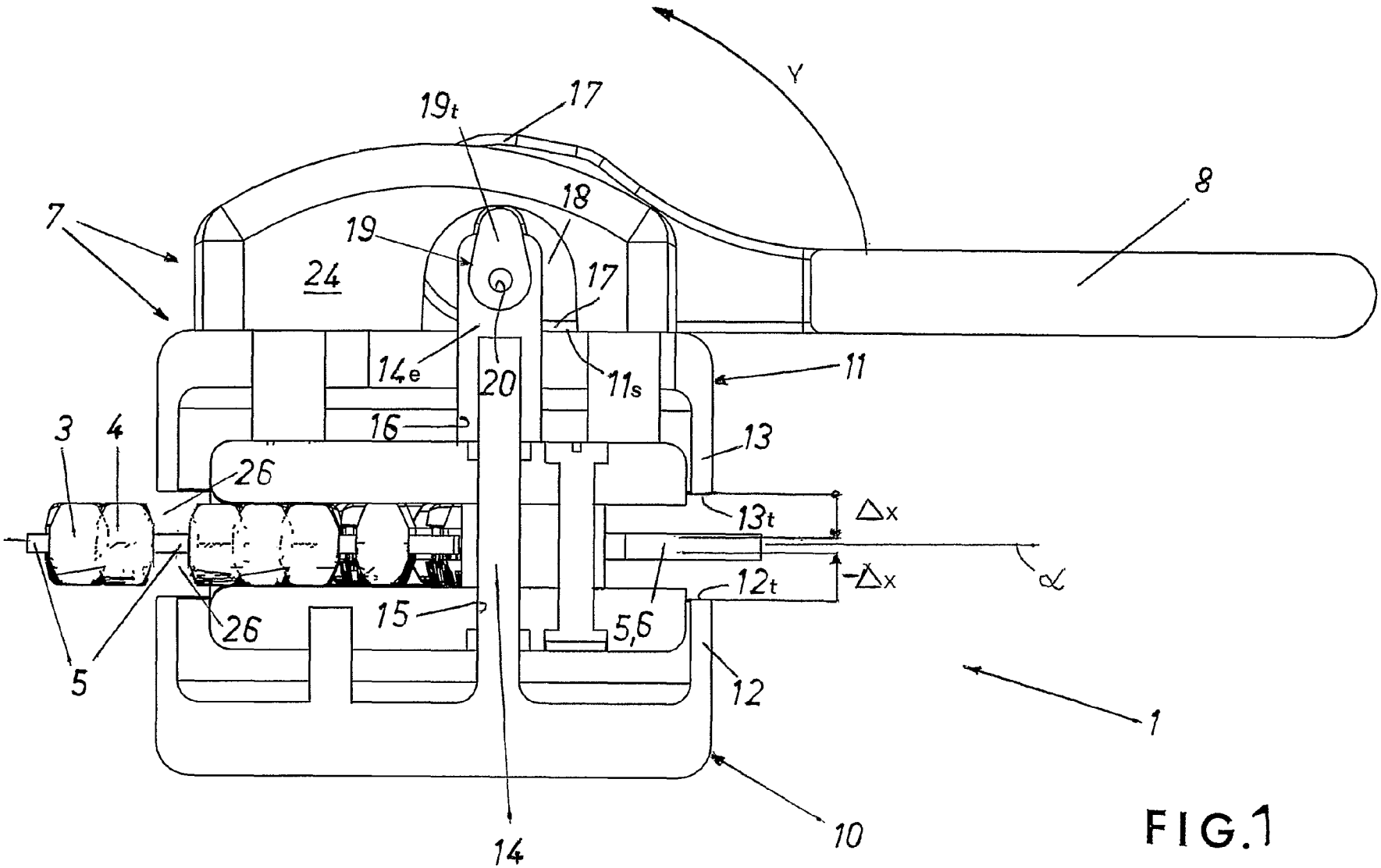
FIG. 1 is an enlarged cross-section through a first example of embodiment of the zip fastener according to the invention, with the said capsules spaced from each other.
Figure 2:
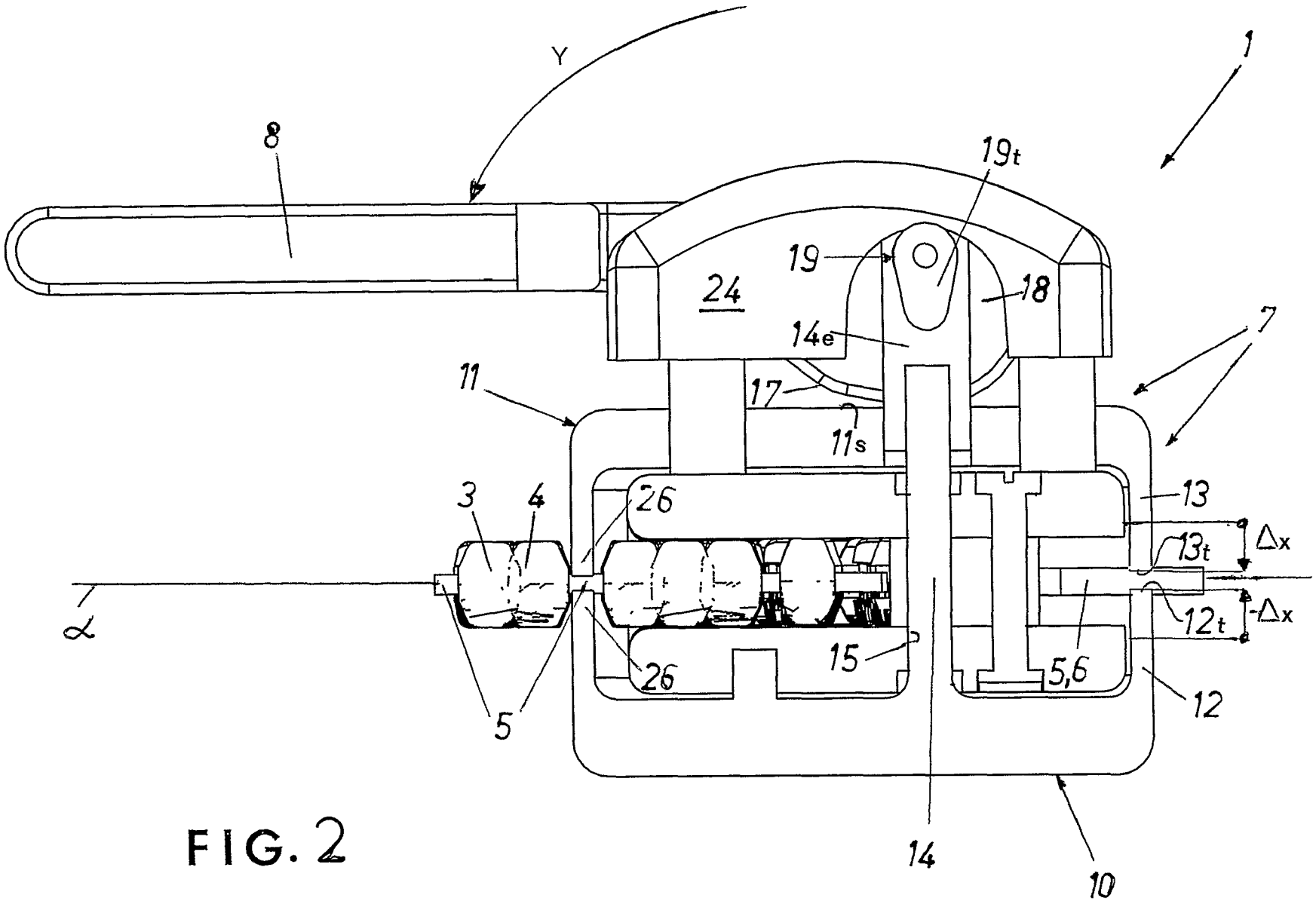
FIG. 2 is the same cross-section as in FIG. 1 with the capsules brought close together and gripping the teeth supporting strips, following a rotation through 180° performed by the slider.
Figure 3:
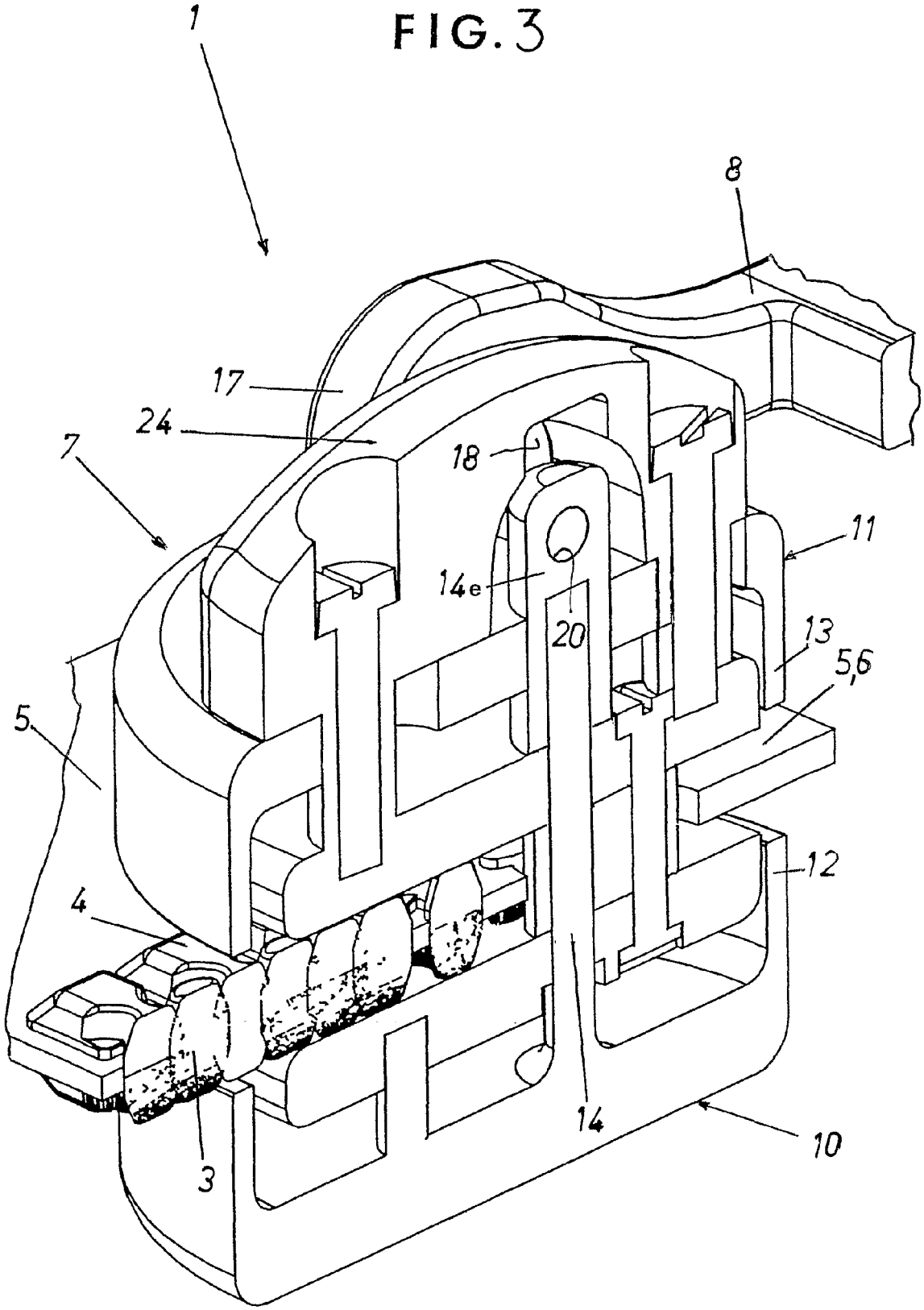
FIG. 3 is a further enlarged prospective cross-sectional view of a detail of the example according to FIGS. 1, 2.

If we consider first of all FIGS. 1, 2, 3 and 4, these show a first example of embodiment of the zip fastener 1 according to the invention, comprising a slider 7, with a pull tag 8, which joins together and disengages two rows of teeth 3, 4 which are fixed onto two compressively elastic strips 5, 6 facing each other along one edge thereof, the displacement of the slider 7 in the two directions being obtained by operating the said pull tag 8 in a known manner.

In the zip fastener 1 according to the invention, however, the said slider 7 is provided, on opposite sides of the said strips 5, 6, with a first concave capsule 10 and a second concave capsule 11 having a form which is substantially a mirror-image of each other and arranged with the perimetral edges 12, 13 of their concavities opposite and facing each other.

The said first capsule 10, which is shown in the lower position, has a perpendicular pin 14 which is directed upwards and passes through a cavity 15 inside the slider 7 as well as a hole 16 formed in the second capsule, so that the two capsules 10, 11 may slide perpendicularly relative to each other along the abovementioned pin 14.

The pull tag 8 is keyed integrally onto a spindle 19 which is pivotably mounted at the ends onto a cap 24 forming part of the slider 7 and the pull tag 8 itself has externally a cam surface 17 which makes contact with the upper wall 11*s* of the said second capsule 11. The abovementioned spindle 19 passes through a transverse hole 20 (see also in this connection the enlarged detail in FIG. 3 where the spindle has been omitted for the sake of clarity) formed in a part 14*n* integral with the free end of the said pin 14 projecting from the first capsule 10 and has at least one section 19*t* which is also cam-shaped and makes contact with a cavity 18 formed inside the said cap 24. This cam-shaped section 19*t* has dimensions and is shaped such that, for a same rotation Y (FIGS. 1 and 2) of the pull tag 8, the second capsule 11 is moved towards the first capsule 10 (as a result of rotation of the said cam surface 17) over a distance $\Delta x$, equal and opposite to the distance $-\Delta x$ over which the first capsule 10 moves towards the second capsule 11 as a result of rotation of the abovementioned cam-shaped section 19*t*.

The arrangement described above produces the effect that the perimetral sides 12, 13 of the two aforementioned capsules 10, 11 exert, when the pull tag 8 performs a rotation through 180°, two substantially equal and opposing thrusts on the opposite sides of the already described strips 5, 6 which are gripped between them.

Figure 5:
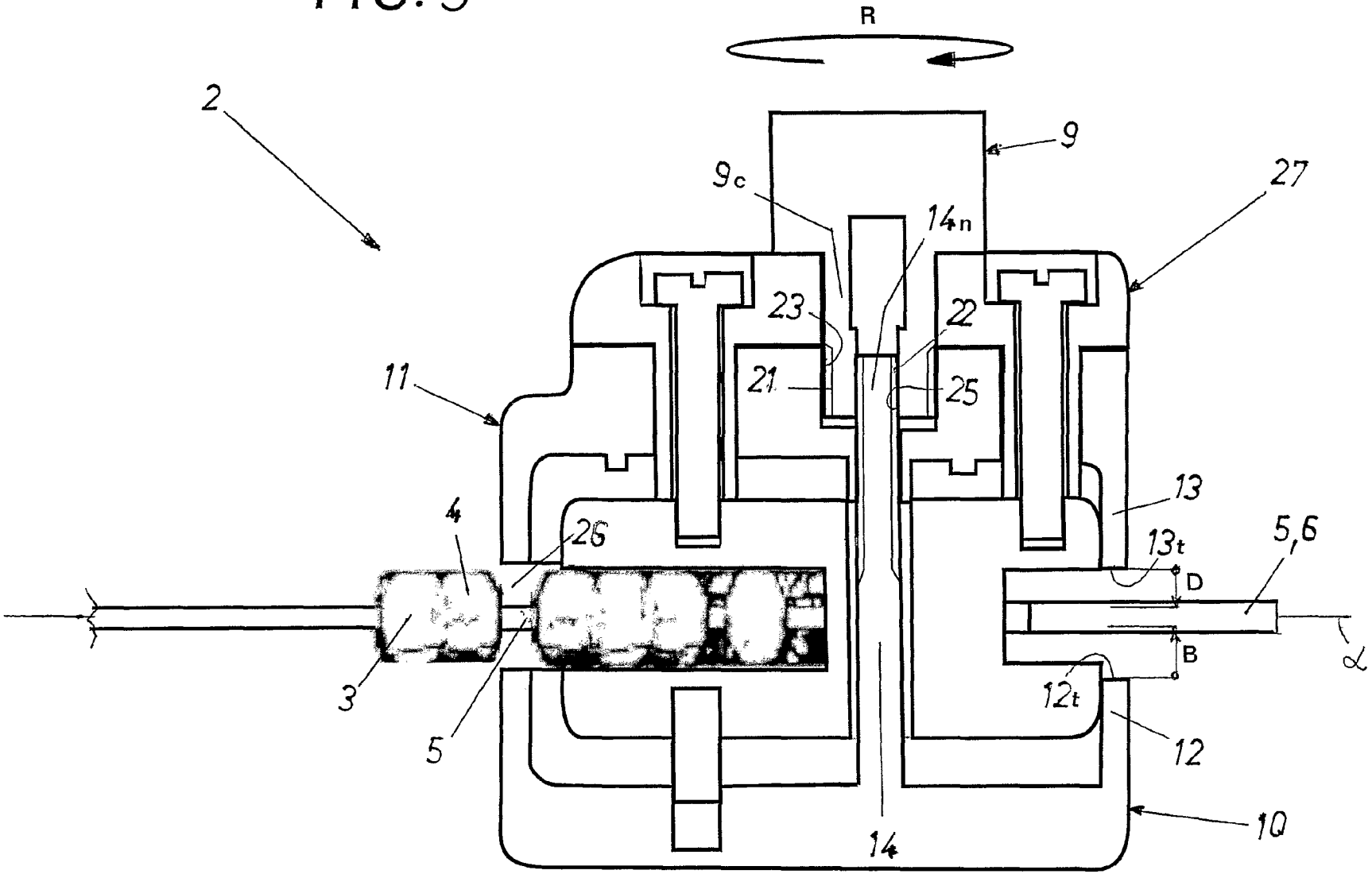
FIG. 5 is an enlarged cross-section through a second example of embodiment of a zip fastener according to the invention with the capsules spaced from each other.
Figure 6:
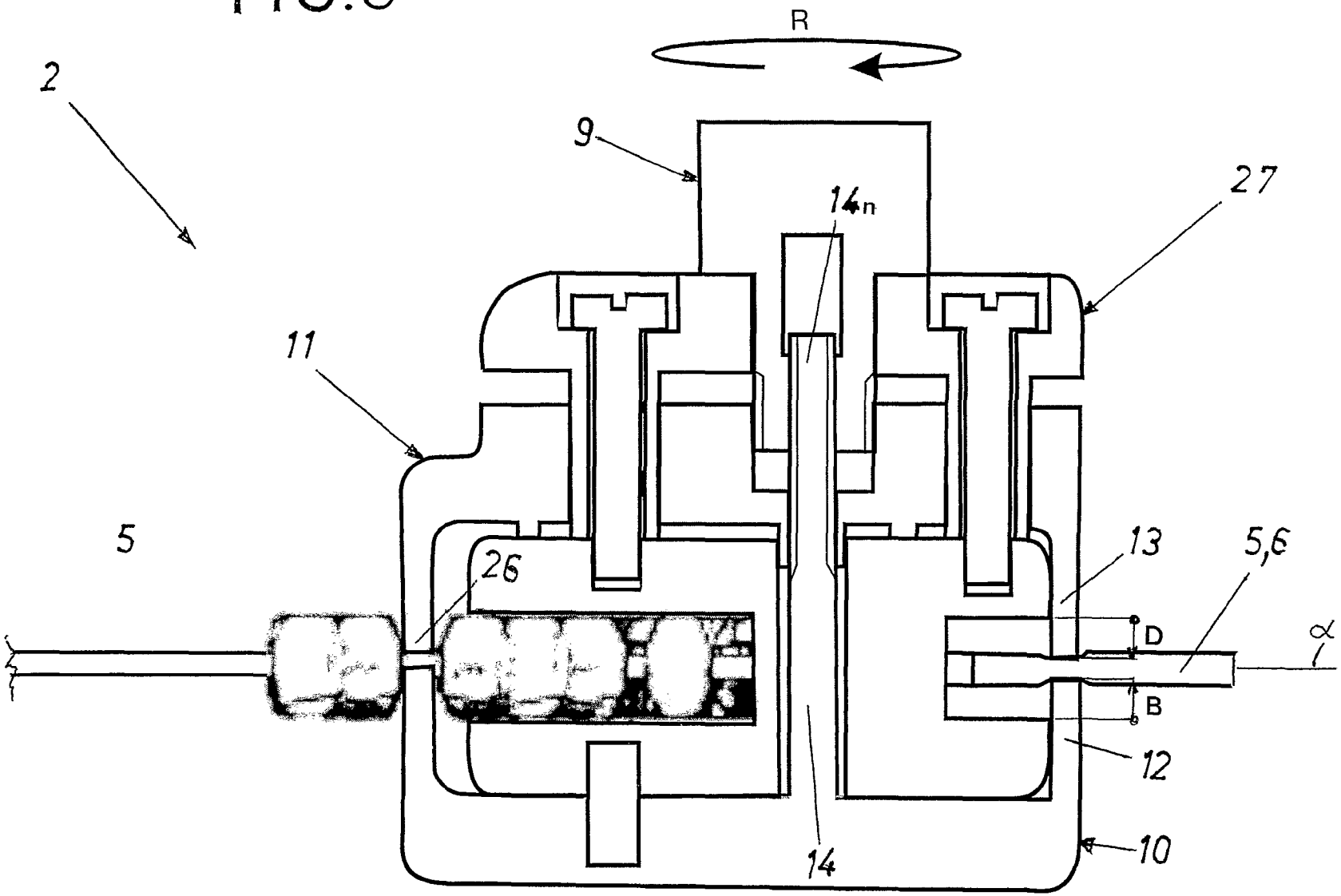
FIG. 6 is the same cross-section as in FIG. 4 with the capsules brought close together and gripping the teeth supporting strips following rotation of a knob which projects vertically from the slider.

FIGS. 5 and 6, on the other hand, show a second example of embodiment of a zip fastener 2 according to the invention. As can be seen in the drawings, the slider 27 is similar to that described for the previous example and also has a first capsule 10 with spindle 14 and a second capsule 11 through which the said spindle 14 passes. The form and the arrangement of the two capsules 10, 11 is entirely similar to that described for the previous example, but the gripping member for moving the slider 27 is a knob 9, which is preferably knurled in order to improve the gripping action and has a cylindrical portion 9*c* provided with a threaded coaxial hole 25 having a first thread 22 which mates with the threaded free end 14*n* of the pin 14 projecting from the first capsule 10.

The abovementioned cylindrical portion 9*c* also has externally a second thread 21 which has a direction opposite to that of the first thread 22 and which engages inside a threaded hole 23 formed in the second capsule 11, the pitch and direction of the various threads being such that a rotation R of the said knob 9 causes two displacements B, D of the two capsules 10, 11 in an opposite direction, parallel to the axis of the said pin 14, so that they are able to grip between them the strips 5, 6 with a desired pressure, as shown in FIG. 6.

In both the cases described hitherto, the advantage—important for a hermetically sealed zip fastener—of being able to achieve the above described gripping of the elastic strips (namely hermetic closure of the zone exposed to the risk of infiltration) with movements and/or rotations of a limited degree has been obtained. In both cases, in fact, the rotational movement Y of the pull tag 8 and the rotational movement R of the knob 9 both cause, simultaneously, two closing movements (Δx, −Δx, B, D), the sum of which produce a double gripping action on the strips 5, 6 between the capsules 10, 11, between the end parts 12*t*, 13*t* of the perimetral edges 12, 13.

In order to ensure an effective action of the capsules 10, 11 on the strips 5, 6, the inventor envisages forming, on the set or sets of teeth 3, 4 which are situated between the perimetral edges 12, 13 of the capsules 10, 11, grooves 26 able to contain in a complementary manner the end parts 12*t*, 13*t* of the said perimetral edges when they have been moved towards each other as fully as possible, namely when the zip fastener 1, 2 has been closed and sealed hermetically by means of gripping of its strips 5, 6 between the capsules 10, 11.

Figure 4:
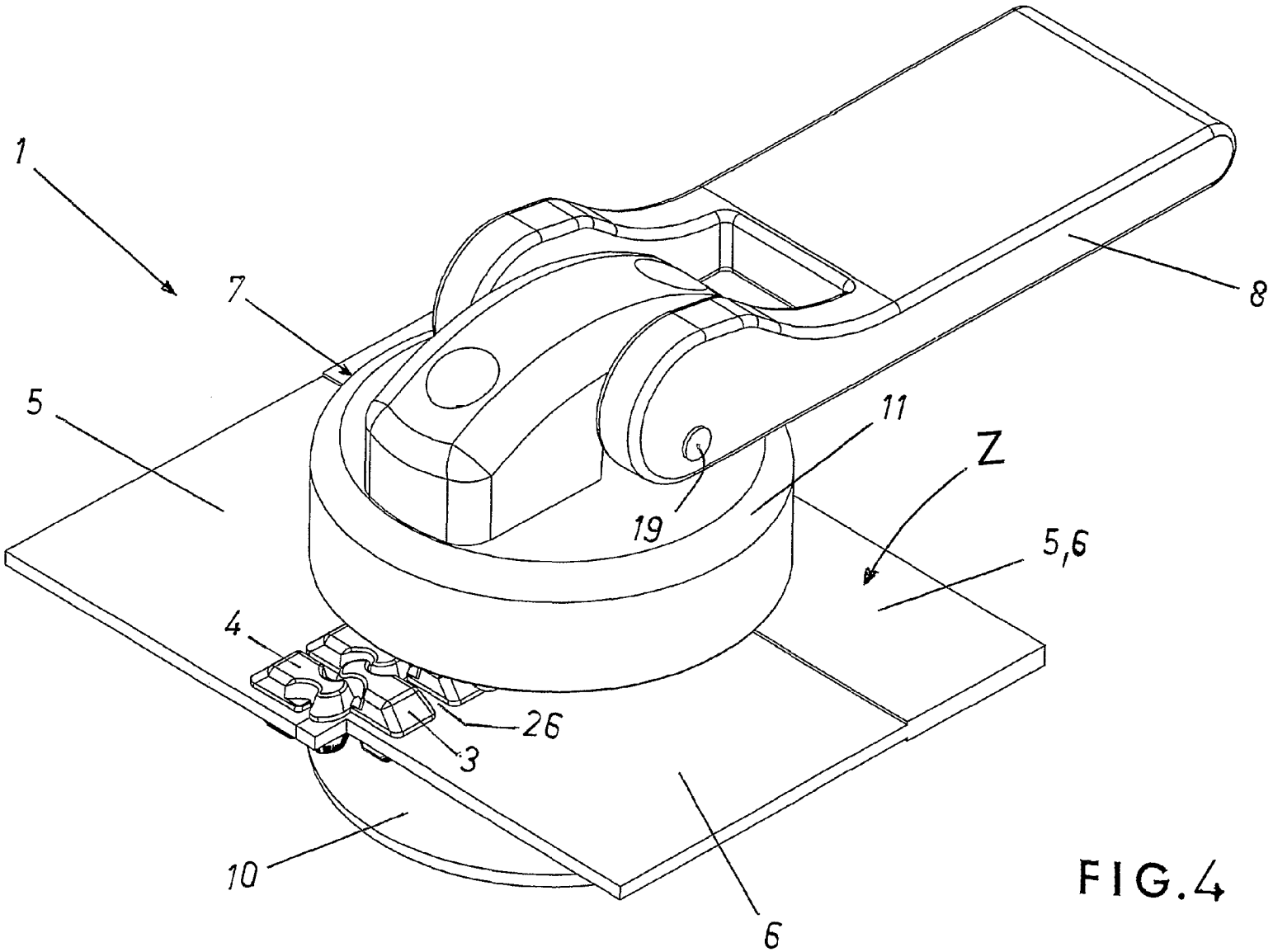
FIG. 4 is a perspective view of the example of embodiment of the above figures.

A further measure envisaged by the inventor for ensuring the hermetic closure of a zip fastener provided in accordance with the invention consists in designing the strips 5, 6 on which the teeth 3, 4 are mounted so that they form a whole, as shown in FIG. 4 in connection with the first example, or so that they are hermetically joined together (condition not shown) in the zone Z situated beyond the end part of the zip fastener which is totally occupied by the slider (7 in this case) when the said zip fastener is totally closed.

In order to illustrate this measure more clearly in the drawings the strip part of the said zone Z shown on the right-hand side of the slider in all the figures has been indicated by the reference numbers 5, 6 relating to the two parts of the strips situated on the left of the slider.

The invention claimed is:

1. A hermetically sealed impermeable zip fastener (1, 2), comprising:

two rows of facing teeth (3, 4) mounted on two strips (5, 6) of compressively elastic material, the teeth being joined together and disengaged by a movable slider (7, 27) which can be displaced by gripping its outwardly projecting gripping member (8, 9), wherein, on opposite sides of the strips (5, 6), the slider (7, 27) is provided with a first concave capsule (10) and a second concave capsule (11) having a form substantially the mirror-image of each other and arranged with the perimetral edges (12, 13) of their concavities opposite and facing each other, the first capsule having directed upwards a pin (14) perpendicular thereto and able to slide perpendicularly through a cavity (15) inside the slider (7) and through a hole (16) formed in the second capsule (11), the gripping member (8, 9) being connected to or having means (17, 18, 19, 20) which, when actuated, cause a simultaneous displacement of the first capsule (10) towards the second capsule (11) and of the second capsule (11) towards the first capsule (10) perpendicular to the plane (α) of the zip fastener (1), which causes a movement, towards each other, of the end parts (12*t*, 13*t*) of the perimetral edges (12, 13) of the capsules (10, 11) sufficient to grip between them, with a desired pressure, the strips (5, 6), the gripping member is a pull tag (8) which is keyed onto a spindle (19) keyed at the ends onto a cap (24) integral with the slider (7) and which has a cam surface (17) which is in contact with the upper wall (11*s*) of the second capsule (11), this spindle (19) passing through a transverse hole (20) formed in a part (14*n*) integral with the free end of the pin (14) projecting from the first capsule (10) and having at least one section (19*t*) which is also cam-shaped and in contact with a cavity (18) formed in the cap (16) designed so that, for a same rotation of the pull tag (8), the second capsule (11) is displaced towards the first capsule (10) over a distance (Δx) by the action of the cam surface (17) and the first capsule (10) is displaced towards the second capsule (11) over an equal and opposite distance (−Δx) by the section (19*t*) of the spindle (19) so that the two capsules (10, 11) exert two substantially equal and opposing thrusts on the opposite sides of the strips (5, 6) which are gripped between them.

2. The zip fastener according to claim 1, further comprising:

grooves (26) formed on the set or sets of teeth (3, 4) which are situated between the two perimetral edges (12, 13) of the abovementioned capsules (10, 11), said grooves being able to contain in a complementary manner the end parts (12*t*, 13*t*) of the perimetral edges (12, 13) when they have been moved towards each other as closely as possible.

3. The zip fastener according to claim 1, wherein the two strips (5, 6) on which the teeth (3, 4) are mounted form a whole or are hermetically joined together in the zone (Z) situated beyond the end part of the zip fastener (1) occupied by the slider (7) when the zip fastener (1) is totally closed.

4. A hermetically sealed impermeable zip fastener (1, 2), comprising:

two rows of facing teeth (3, 4) mounted on two strips (5, 6) of compressively elastic material, the teeth being joined together and disengaged by a movable slider (7, 27) which can be displaced by gripping its outwardly projecting gripping member (8, 9), wherein, on opposite sides of the strips (5, 6), the slider (7, 27) is provided with a first concave capsule (10) and a second concave capsule (11) having a form substantially the mirror-image of each other and arranged with the perimetral edges (12, 13) of their concavities opposite and facing each other, the first capsule having directed upwards a pin (14) perpendicular thereto and able to slide perpendicularly through a cavity (15) inside the slider (7) and through a hole (16) formed in the second capsule (11), the gripping member (8, 9) being connected to or having means (17, 18, 19, 20) which, when actuated, cause a simultaneous displacement of the first capsule (10) towards the second capsule (11) and of the second capsule (11) towards the first capsule (10) perpendicular to the plane (of) of the zip fastener (1), which causes a movement, towards each other, of the end parts (12*t*, 13*t*) of the perimetral edges (12, 13) of the capsules (10, 11) sufficient to grip between them, with a desired pressure, the strips (5, 6), the gripping member is a knob (9) having a cylindrical portion (9*c*) provided with a coaxial hole (25) having a first thread (22) which mates with the threaded free end (14*n*) of the pin (14) provided on the first capsule (10), this cylindrical portion (9*c*) having externally also a second thread (21) , with a direction opposite to that of the first thread (22), which engages inside a threaded hole (23) formed on the second capsule (11) so that a rotation (R) of the knob (9) causes two displacements (B, D) of the two capsules (10, 11) in opposite directions, parallel to the axis of the pin (14), able to grip between them the strips (5, 6) with a desired pressure.

5. The zip fastener according to claim 4, wherein the side surface of the knob (9) is knurled.

6. The zip fastener according to claim 5, further comprising:

grooves (26) formed on the set or sets of teeth (3, 4) which are situated between the two perimetral edges (12, 13) of the abovementioned capsules (10, 11), said grooves being able to contain in a complementary manner the end parts (12*t*, 13*t*) of the perimetral edges (12, 13) when they have been moved towards each other as closely as possible.

7. The zip fastener according to claim 4, wherein the two strips (5, 6) on which the teeth (3, 4) are mounted form a whole or are hermetically joined together in the zone (Z) situated beyond the end part of the zip fastener (1) occupied by the slider (7) when the zip fastener (1) is totally closed.

8. The zip fastener according to claim 4, further comprising:

grooves (26) formed on the set or sets of teeth (3, 4) which are situated between the two perimetral edges (12, 13) of the abovementioned capsules (10, 11), said grooves being able to contain in a complementary manner the end parts (12*t*, 13*t*) of the perimetral edges (12, 13) when they have been moved towards each other as closely as possible.

9. The zip fastener according to claim 4, wherein the two strips (5, 6) on which the teeth (3, 4) are mounted form a whole or are hermetically joined together in the zone (Z) situated beyond the end part of the zip fastener (1) occupied by the slider (7) when the zip fastener (1) is totally closed.

10. A hermetically sealed impermeable zip fastener (1, 2), comprising:

two rows of facing teeth (3, 4) mounted on two strips (5, 6) of compressively elastic material, the teeth being joined together and disengaged by a movable slider (7, 27) which can be displaced by gripping its outwardly projecting gripping member (8, 9), wherein, on opposite sides of the strips (5, 6), the slider (7, 27) is provided with a first concave capsule (10) and a second concave capsule (11) having a form substantially the mirror-image of each other and arranged with the perimetral edges (12, 13) of their concavities opposite and facing each other, the first capsule having directed upwards a pin (14) perpendicular thereto and able to slide perpendicularly through a cavity (15) inside the slider (7) and through a hole (16) formed in the second capsule (11), the gripping member (8, 9) being connected to or having means (17, 18, 19, 20) which, when actuated, cause a simultaneous displacement of the first capsule (10) towards the second capsule (11) and of the second capsule (11) towards the first capsule (10) perpendicular to the plane ($\alpha$) of the zip fastener (1), which causes a movement, towards each other, of the end parts (12*t*, 13*t*) of the perimetral edges (12, 13) of the capsules (10, 11) sufficient to grip between them, with a desired pressure, the strips (5, 6), grooves (26) are formed on the set or sets of teeth (3, 4) which are situated between the said two perimetral edges (12, 13) of the abovementioned capsules (10, 11), said grooves being able to contain in a complementary manner the end parts (12*t*, 13*t*) of the said perimetral edges (12, 13) when they have been moved towards each other as closely as possible, the two strips (5, 6) on which the teeth (3, 4) are mounted form a whole or are hermetically joined together in the zone (Z) situated beyond the end part of the zip fastener (1) occupied by the slider (7) when the zip fastener (1) is totally closed.

* * * * *